United States Patent [19]

Strub

[11] 3,986,646

[45] Oct. 19, 1976

[54] PLASTIC CLOSURE TOP FOR TINS

[75] Inventor: Hans Strub, Furstentum, Liechtenstein

[73] Assignee: Patentkommerz AG, Zurich, Switzerland

[22] Filed: July 2, 1974

[21] Appl. No.: 485,183

[30] Foreign Application Priority Data

July 12, 1973 Switzerland ..... 10162/73
June 10, 1974 Switzerland ..... 7911/74

[52] U.S. Cl. ..... 222/529
[51] Int. Cl.[2] ..... B67D 5/12
[58] Field of Search ..... 222/529, 530, 552

[56] References Cited

UNITED STATES PATENTS

| | | | |
|---|---|---|---|
| 2,243,673 | 5/1941 | Henry | 222/530 |
| 2,895,654 | 7/1959 | Rieke | 222/530 X |
| 3,093,273 | 6/1963 | Borah | 222/530 X |
| 3,204,827 | 9/1965 | Krautkramer | 222/530 X |
| 3,216,632 | 11/1965 | Dearing | 222/552 X |
| 3,690,522 | 9/1972 | Chlystun | 222/529 |
| 3,856,187 | 12/1974 | Chlystun | 222/529 |

*Primary Examiner*—Allen N. Knowles
*Assistant Examiner*—Norman L. Stack, Jr.
*Attorney, Agent, or Firm*—Lawrence Rosen; E. Janet Berry

[57] ABSTRACT

An integral molded plastic closure for a container opening, wherein the closure comprises a base, a spout separated from the base and a collapsible bellows joining the base and the spout; integrally formed with and to the spout is a separable closure element comprising a hollow cylinder closed off by a sealing disc; the open end of the closure element cylinder is integrally formed to the open end of the spout; a tearable section integral with both the closure element cylinder and the spout is defined between these elements, whereby the cylinder may be separated from the spout; the spout opening and the closure element cylinder are cooperatingly contoured to enable the closure element spout to pass into and seal the spout opening.

4 Claims, 8 Drawing Figures

PLASTIC CLOSURE TOP FOR TINS

The invention relates to a plastic closure top for tins, comprising a ring at the base which is designed to be inserted into the mouth of the tin and a compressible bellows which is continuous with a spout, and a closure element which is integrally connected with the spout by being extruded in one piece, with interposition of at least one tear line.

In known embodiments, a grip is attached to the top of the cap for pulling out the spout by stretching the bellows.

This known embodiment must be constructed in two parts because the closure cap must be formed separately. This two-part construction not only involves higher production costs but also additional costs for assembly.

It is an object of this invention to provide a plastic closure top which obviates the need for separate production of a screw cap.

According to the invention, this problem is solved by constructing the element as a reusable spout top which is designed not to be separated from the spout until the tin is opened for the first time.

The design according to the invention makes it possible to construct the whole closure top in one piece, i.e. it can be extruded as one piece in all its details.

The reusable spout top is torn off at the tear line when the tin is first opened and it can subsequently be used as a stopper which can be pushed into or over the spout.

A flexible grip is advantageously arranged eccentrically on the closure top for the purpose of pulling out and stretching the bellows. This is important to ensure that when the bellows is pulled out the hollow cylinder is not at the same time torn off the spout along the tear line. This tear line is therefore preferably made thicker underneath the grip than underneath the handle which is situated on the opposite side.

A handle may be provided on the closure top, for example opposite the grip, to enable the hollow cylinder to be more easily torn from the spout.

In addition, supporting elements may be provided on the undersurface of the closure top. When the hollow cylinder has been torn off and is inserted into the spout, these supporting elements engage with the underside of corresponding parts on the edge of the spout to form a bayonet-like seal.

Two examples of a plastic closure top according to the invention are shown schematically in the drawings.

Figure 1:
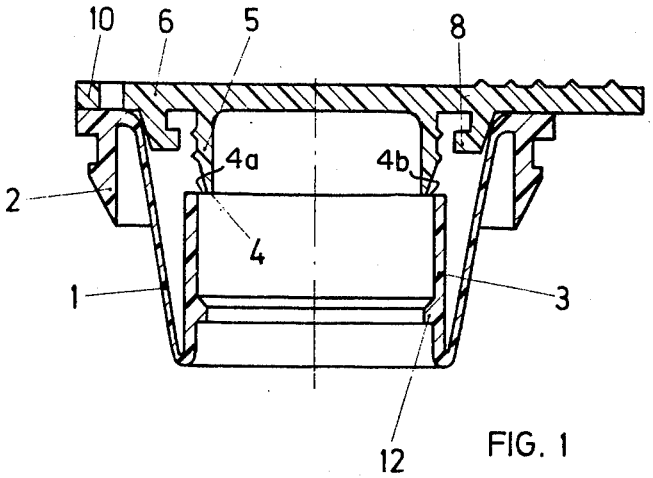
FIG. 1 is a longitudinal section through the device in its original inverted position.
Figure 2:
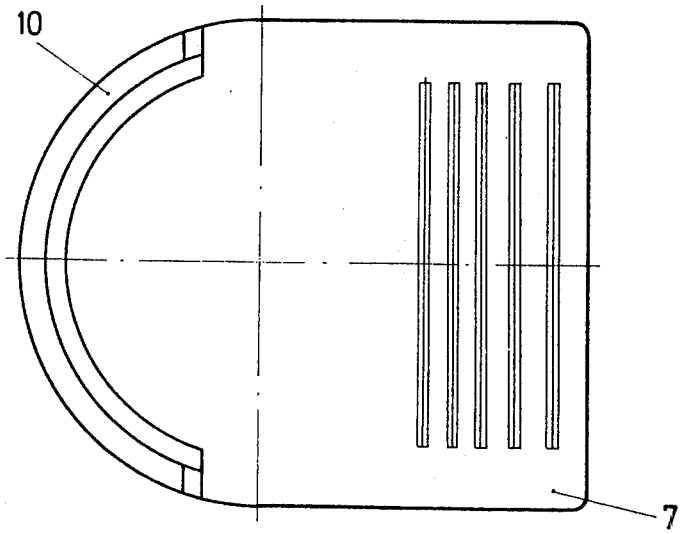
FIG. 2 is a top plan view of FIG. 1.
Figure 3:
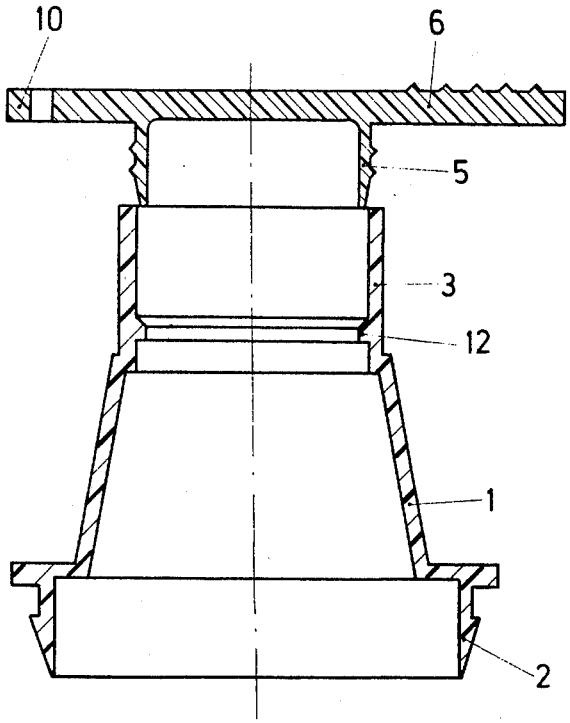
Figure 4:
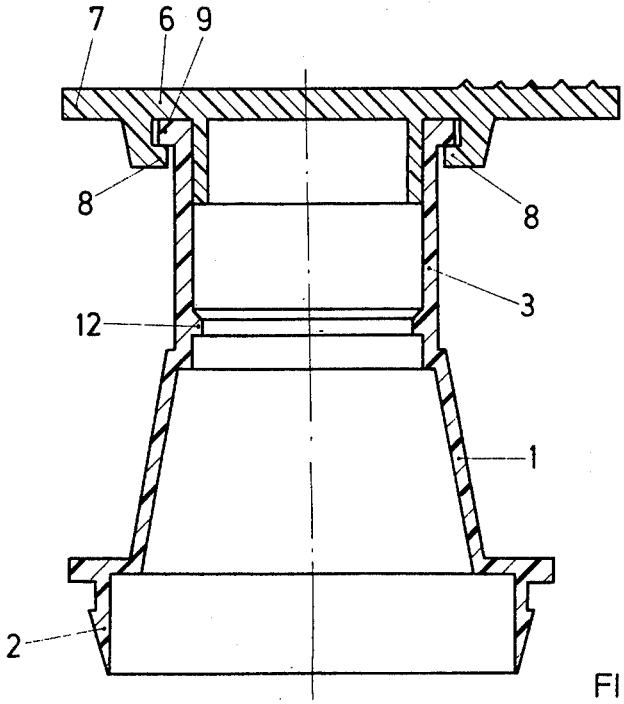
Figure 5:
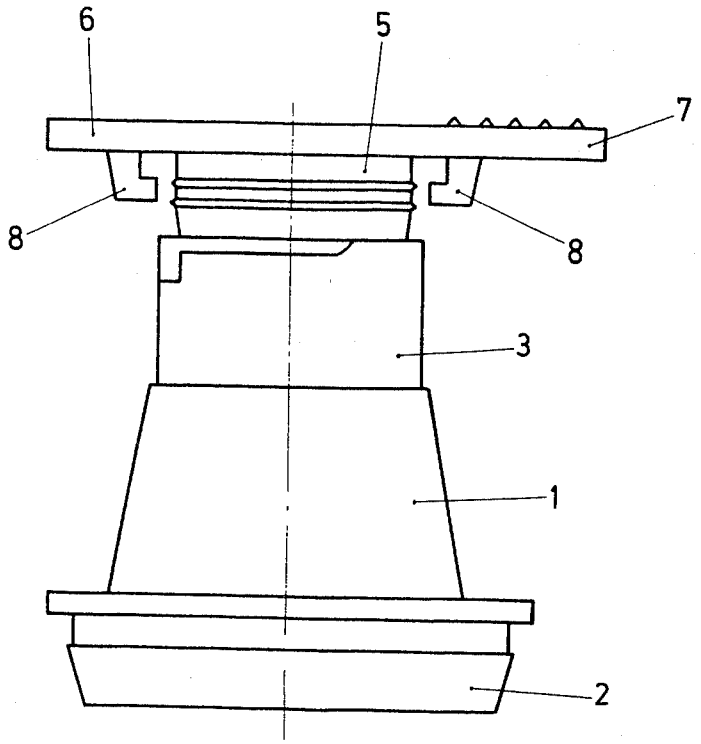
Figure 6:
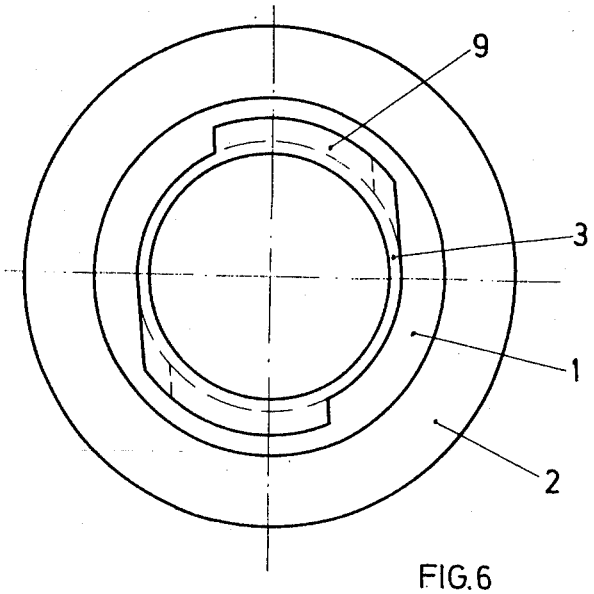
Figure 7:
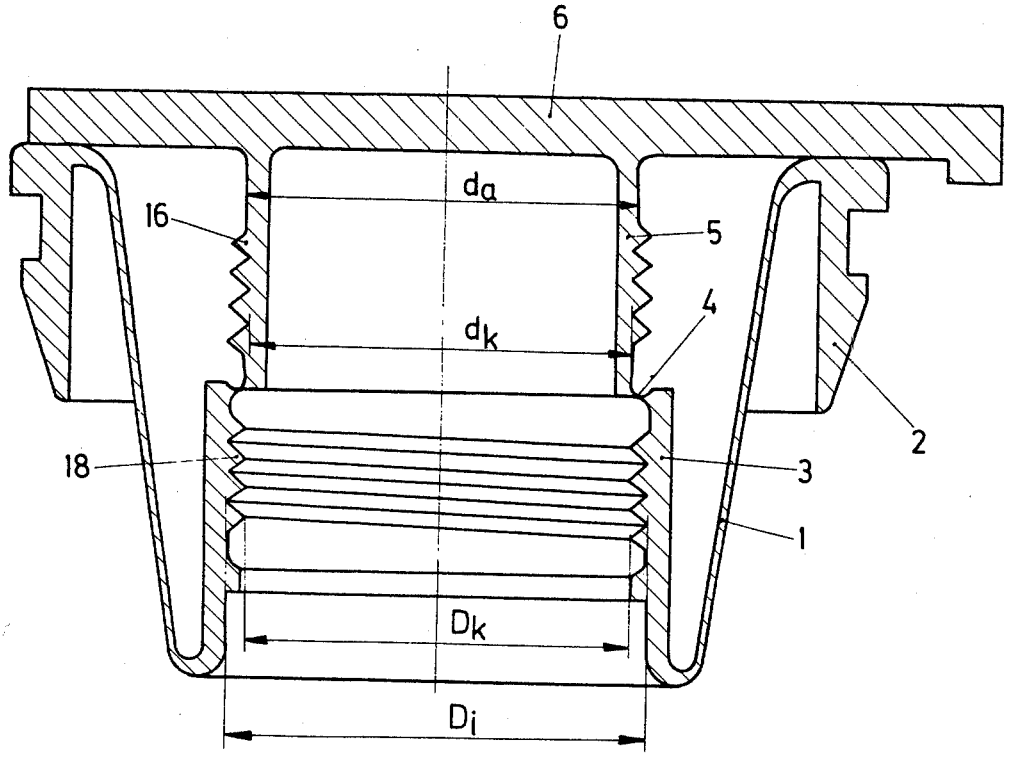

FIG. 3 is a longitudinal section through the closure top with the bellows pulled out before the tin is first opened, FIG. 4 is a longitudinal section through the closure top after it has been put into use and closed again, FIG. 5 is a side view again showing a closure top before it is first put into use, with the hollow cylinder rotated, FIG. 6 is a top plan view showing the opened closure top without the hollow cylinder, FIG. 7 shows another embodiment of a closure top analogous to that of FIG. 1.

As can be seen from FIGS. 1–7, the plastic closure top consists of a base ring 2 which serves to fix the top to a tin, a bellows 1, a spout 3 and, with interposition of a tear line 4, a hollow cylinder 5 moulded on to the spout 3 and having a disc-shaped closure element 6.

In the embodiment according to FIGS. 1–6, the spout 3 has an annular beading 12 on the inside. Instead of this beading, one or more individual projections can be provided or the spout could have several such internal beadings. When the hollow cylinder 5 with closure disc 6 has been torn off along the tear line 4, it can be used as stopper to close the spout after use since the hollow cylinder 5 can be inserted into the spout 3.

The external diameter of the hollow cylinder 5 is therefore equal to the internal diameter of the spout 3.

In principle, this hollow cylinder could also be designed to fit over the spout instead of into it, but this is less desirable for manufacturing technical reasons. To facilitate tearing of the hollow cylinder 5 from the edge of the spout 3, a handle 7 is provided on the closure disc 6.

To close the tin after use, the closure disc 6 is turned after insertion of the hollow cylinder 5 into the spout 3 so that the supporting elements on the underside of the disc 6 fit like clamps 8 over corresponding members 9 provided on the spout 3.

The inwardly projecting cam or cams or continuous beading 12 on the internal surface of the cylindrical spout 3 serve or serves to turn the moulded element automatically inside out on removal from the mould. During the process of removal from the mould, the mould core inside the spout 3 is pulled back and consequently the stretched spout 3 is pulled along with it by the base ring 2 and automatically turned inside out. When this has been completed, the moulding is ejected by means of two ejector sleeves (not shown).

In the process of manufacturing the closure top, i.e. in the process of extrusion, care should be taken to ensure that the clamps 8 and their counter members 9 are arranged at an angle of about 90° from each other because only then is fully automatic removal of the moulded article from the mould possible.

Figure 1A:
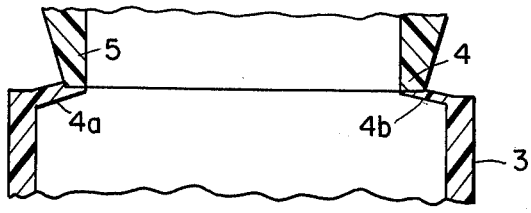
FIG. 1*a* is an enlarged, fragmentary view of a portion of the device of FIG. 1, more clearly showing the tearable section.

For removal of the whole closure top and stretching of the bellows 1, a flexible grip 10 is provided eccentrically on the closure disc 6 opposite the handle 7. As shown in FIG. 1*a*, the tear line material near region 4*a* of the tear line 4 is thicker than that material near region 4*b*. As shown in FIG. 1, thicker region 4*a* is in the vicinity of the grip 10, whereas thinner region 4*b* is in the vicinity of the handle 7. The handle 7 is the element that is grasped and pulled for initially tear separating the spout 3 and hollow cylinder 5. The thinness of region 4*b* of the tear line 4 ensures that when the handle 7 is pulled, it exerts force at the region 4*b* and this causes the first tearing of the tear line 4 at region 4*b*. More important, the greater thickness at region 4*a* ensures that when the grip 10 is drawn for inverting or pulling out the closure from the condition of FIG. 1 to the condition of FIG. 3, this will not undesirably separate closure 5 from spout 3.

It has been found that a plastic closure top according to FIGS. 1–6 in some cases does not satisfy the requirements in the sense that the stopper can be removed rather easily from the spout after it has been inserted. The reason for this is that a relatively flexible material must be used to produce the bellows which can be turned inside out, and difficulties may therefore arise when using a bayonet type seal. Such a loose seal can be a disadvantage if, for example a container closed with such a stopper is put into the boot of the car where it is liable to slip about when the car is in motion. Any accidental impact especially against the handle of the stopper is then liable to open the tin unnoticed so that the contents leak out.

The hollow cylinder 5 is therefore provided with an external thread 16 the root diameter *dk* of which is smaller than the external diameter *da* of the hollow cylinder 5. This means that the thread 16 is recessed or formed as a negative thread in the stopper.

A corresponding internal thread 18 is provided in the spout 3. This thread has a root diameter DK which is smaller than the internal diameter DI of the spout 3. The turns of the thread are therefore in this case raised or positive.

The external diameter *da* of the stopper is preferably approximately equal to the internal diameter DI of the spout 3 with a slight clearance to make it easy to fit the two parts together.

This design results in a firm grip between the two parts. The thread 16, 18 may advantageously be saw-toothed. A beading 20 is advantageously provided to extend right round the stopper above the thread 16 so that when the two parts are screwed together it dips into the cylinder of the spout 3 to form a seal. In the region of the tear line 4, a small conical attachment 14 is provided which projects into the interior of the spout so that when the stopper has been torn off it can be introduced more easily into the spout 3.

By designing the plastic closure top according to the invention as a single piece, fully automatic moulding and fully automatic removal of the moulded article from the mould becomes possible.

Higher production rates and lower manufacturing costs are thereby achieved.

I claim:

1. Plastic closure means for closing an opening in a container:

said closure means having a base, said base having a bottom which has an opening; a ring extending around the exterior of said base, said ring being adapted to be introduced into the container opening and said ring being shaped so as to close the container opening; means at said base for seating against the container, thereby to hold said closure means in position on the container;

a spout comprising an opening into said closure means being provided at the opposite end of said closure means from said base;

a compressible bellows extending from said base to said spout; said closure means being hollow from said base opening through said bellows to said spout opening, thereby to enable fluent material to pass completely through said closure means;

a closure element integrally connected with said spout around said spout opening; said closure element comprising a hollow sleeve having a first end which is integrally connected to said spout around said spout opening; said hollow sleeve having an opposite second end; an integrally connected disc-like means secured on said sleeve second end of said closure element to completely seal the second end of said closure element;

said closure element sleeve having a first contour; said spout opening having a second contour substantially conforming to said first contour, thereby to enable said closure element sleeve to enter into and sealingly close said spout opening and to thereafter be removed from said spout opening;

a flexible grip integrally joined to the disc-like means and extending eccentrically from one side of said disc-like means for being grasped and for enabling pulling on said closure means by said grip;

a handle integrally formed in said disc-like means opposite said grip and adapted to be grasped to tear said closure element sleeve off said spout for enabling removal of said closure element from said spout;

the integral connection between said spout and said closure element first end comprising a tearable section that is comprised of such material and that is of such thickness and that has such characteristics that it is adapted to be torn upon application of tearing force thereto when the disc-like means is pulled open, thereby to initially separate the integrally connected said spout and said closure element;

said grip being attached at one side of said disc-like means; said tearable section being of varying thickness such that in the region of said grip, said tearable section material is thicker than the thickness of said tearable section material in the region away from said grip and in the region of said handle, thereby to prevent initiation of tearing of said closure element from said spout when said bellows is pulled out by said grip while permitting initiation of said tearing when said handle is pulled away from said spout.

2. Plastic closure means for closing an opening in a container:

said closure means having a base, said base having a bottom which has an opening; a ring extending around the exterior of said base, said ring being adapted to be introduced into the container opening and said ring being shaped so as to close the container opening; means at said base for seating against the container, thereby to hold said closure means in position on the container;

a spout comprising an opening into said closure means being provided at the opposite end of said closure means from said base;

a compressible bellows extending from said base to said spout; said closure means being hollow from said base opening through said bellows to said spout opening, thereby to enable fluent material to pass completely through said closure means;

a closure element integrally connected with said spout around said spout opening; said closure element comprising a hollow sleeve having a first end which is integrally connected to said spout around said spout opening; said hollow sleeve having an opposite second end; an integrally connected disc-like means secured on said sleeve second end of said closure element to completely seal the second end of said closure element;

said closure element sleeve having a first contour; said spout opening having a second contour substantially conforming to said first contour, thereby to enable said closure element sleeve to enter into and sealingly close said spout opening and to thereafter be removed from said spout opening;

the integral connection between said spout and said closure element first end comprising a tearable section that is comprised of such material and that is of such thickness that has such characteristics that it is adapted to be torn upon application of tearing force thereto when said disc-like means is pulled open, thereby to initially separate the integrally connected said spout and said closure element;

supporting projection means inside of and projecting into said spout and being located along the length of said spout a distance away from said tearable section.

3. Plastic closure means for closing an opening in a container:

said closure means having a base, said base having a bottom which has an opening; a ring extending around the exterior of said base, said ring being adapted to be introduced into the container opening and said ring being shaped so as to close the container opening; means at said base for seating against the container, thereby to hold said closure means in position on the container;

a spout comprising an opening into said closure means being provided at the opposite end of said closure means from said base;

a compressible bellows extending from said base to said spout; said closure means being hollow from said base opening through said bellows to said spout opening, thereby to enable fluent material to pass completely through said closure means;

a closure element integrally connected with said spout around said spout opening; said closure element comprising a hollow sleeve having a first end which is integrally connected to said spout around said spout opening; said hollow sleeve having an opposite second end; an integrally connected disc-like means secured on said sleeve second end of said closure element to completely seal the second end of said closure element;

said closure element sleeve having a first contour; said spout opening having a second contour substantially conforming to said first contour, thereby to enable said closure element sleeve to enter into and sealingly close said spout opening and to thereafter be removed from said spout opening;

the integral connection between said spout and said closure element first end comprising a tearable section that is comprised of such material and that is of such thickness that has such characteristics that it is adapted to be torn upon application of tearing force thereto when said disc-like means is pulled open, thereby to initially separate the integrally connected said spout and said closure element;

said closure element sleeve having an external thread and said spout having a cooperating internal thread, thereby to enable said closure element to be screwed into said spout.

4. Plastic closure means according to claim 3, wherein the exterior of said closure element sleeve tapers narrower inwardly into said spout in the region of said closure element sleeve first end to facilitate insertion of said closure element sleeve into said spout.

* * * * *